US012628922B2

(12) United States Patent
Zhai et al.

(10) Patent No.: US 12,628,922 B2
(45) Date of Patent: May 19, 2026

(54) SMART RING HAVING TWO BODIES ROTATABLE RELATIVE TO EACH OTHER

(71) Applicant: GYGES LABS PTE. LTD., Singapore (SG)

(72) Inventors: Yingnan Zhai, Shenzhen (CN); Can Ye, Shenzhen (CN); Junzhu Tang, Shenzhen (CN); Zhujun Tang, Shenzhen (CN); Yanzhi Chen, Shenzhen (CN); Zheng Lyu, Shenzhen (CN)

(73) Assignee: GYGES LABS PTE. LTD., Singapore (SG)

( * ) Notice: Subject to any disclaimer, the term of this patent is extended or adjusted under 35 U.S.C. 154(b) by 28 days.

(21) Appl. No.: 18/774,686

(22) Filed: Jul. 16, 2024

(65) Prior Publication Data

US 2025/0351929 A1 Nov. 20, 2025

(30) Foreign Application Priority Data

May 17, 2024 (CN) ..... 202410622403.3
May 31, 2024 (CN) ..... 202421232814.3

(51) Int. Cl.
*G06F 1/16* (2006.01)
*A44C 9/00* (2006.01)

(52) U.S. Cl.
CPC ..... *A44C 9/0053* (2013.01)

(58) Field of Classification Search
CPC ..... G06F 1/163; G06F 3/014; G06F 3/016; G06F 2203/0331; A44C 9/0053
See application file for complete search history.

(56) References Cited

U.S. PATENT DOCUMENTS 6,101,843 A * 8/2000 Nagano ..... A44C 9/003 63/15.3
11,714,494 B2 * 8/2023 D'Amone ..... G06F 3/0362 345/156
2011/0007035 A1 * 1/2011 Shai ..... G06F 3/0304 345/179
2022/0091683 A1 * 3/2022 Beyhs ..... G06F 3/03547
2023/0072436 A1 * 3/2023 Sanchez ..... H02J 50/001
2025/0135689 A1 * 5/2025 Lämsä ..... B29C 41/20

* cited by examiner

*Primary Examiner* — Rodney Amadiz
(74) *Attorney, Agent, or Firm* — HSML. P.C.

(57) ABSTRACT

A smart ring includes: a first ring body provided with a receiving hole; a second ring body, the second ring body movably sleeve on a periphery of the first ring body, and a first gap being formed between the first ring body and the second ring body; a trigger assembly arranged on the first ring body and at least partially exposed from the first ring body; and a processing circuit arranged on the first ring body. The first ring body and the second ring body are capable of rotating with each other, the second ring body is further movable in a radial direction of the smart ring, so as to receive a pressing operation and move toward the first ring body and enable an inner side of the second ring body to abut against a portion of the trigger assembly exposed from the first ring body.

20 Claims, 11 Drawing Sheets

C

SMART RING HAVING TWO BODIES ROTATABLE RELATIVE TO EACH OTHER

This application claims priority of Chinese Patent Application No. 2024106224033, filed on May 17, 2024, and Chinese Patent Application No. 2024212328143, filed on May 31, 2024. The contents of the above identified applications are hereby incorporated herein in their entireties by reference.

TECHNICAL FIELD

The present disclosure relates to the field of wearable device technologies, and in particular to a smart ring.

BACKGROUND

In the conventional art, it is common that a wearable device includes a watch or a headset. The watch or headset is provided with a touch screen or a large number of keys, which are relatively complex to operate. For example, structures such as bracelets or rings are mostly used as decorations. How to set the wearable device to a ring or bracelet-like structure to facilitate user control can significantly improve experience of the user for the wearable device.

SUMMARY

According to various embodiments, a smart ring is provided.

A smart ring includes: a first ring body provided with a receiving hole, the receiving hole being configured to accommodate a finger of a wearer; a second ring body movably sleeve on a periphery of the first ring body, and a first gap being formed between the first ring body and the second ring body in a circumferential direction of the smart ring; a trigger assembly arranged on the first ring body and at least partially exposed from the first ring body; and a processing circuit arranged on the first ring body and electrically connected to the trigger assembly. The first ring body and the second ring body are capable of rotating with each other along the first gap, the second ring body is further movable relative to the first ring body in a radial direction of the smart ring, so as to receive a pressing operation and move toward the first ring body and enable an inner side of the second ring body to abut against a portion of the trigger assembly exposed from the first ring body, the trigger assembly is configured to generate a trigger signal when abutting against the second ring body, and the processing circuit is configured to convert the trigger signal into an interactive signal.

In one of the embodiments, the first ring body is provided with a protruding portion, along the width direction of the first ring body, an edge of the second ring body is blocked by the protruding portion.

In one of the embodiments, the smart ring further includes a first magnet circumferentially provided on the first ring body and a second magnet circumferentially provided on the second ring body, the trigger assembly is spaced apart from the first magnet and the second magnet, the first ring body is rotatable relative to the second ring body, and the first ring body and the second ring body are spaced apart in the radial direction under mutual magnetic force between the first magnet and the second magnet.

In one of the embodiments, a magnetic pole of a side of the first magnet facing the second ring body is the same as a magnetic pole of a side of the second magnet facing the first ring body.

In one of the embodiments, a magnetic pole of a side of the first magnet facing the second ring body is different from a magnetic pole of a side of the second magnet facing the first ring body.

In one of the embodiments, a plurality of first magnets and a plurality of second magnets are provided, the plurality of first magnets are spaced apart along the circumferential direction of the first ring body, a first spacing is formed between adjacent two first magnets, the plurality of second magnets are spaced apart along the circumferential direction of the second ring body, a second spacing is formed between adjacent two second magnets, the first magnet extends axially along the first ring body, the second magnet extends axially along the second ring body, a plurality of trigger assemblies are provided, and each trigger assembly is located between adjacent two first magnets.

In one of the embodiments, the first ring body is circumferentially provided with a plurality of first accommodating grooves, each first accommodating groove extends axially along the first ring body, the first magnet is detachably inserted into the first accommodating groove, the second ring body is provided with a plurality of second accommodating grooves, each second accommodating groove extends axially along the second ring body, and the second magnet is detachably inserted into the second accommodating groove.

In one of the embodiments, the first accommodating grooves have different sizes, and the second accommodating grooves have different sizes.

In one of the embodiments, the smart ring further includes a mounting bracket, a flexible printed circuit board, and a battery, the flexible printed circuit board is bent and surrounds the mounting bracket, the battery is electrically connected to the flexible printed circuit board, the processing circuit is arranged on the flexible printed circuit board, and the battery is located in a space formed by bending of the flexible printed circuit board.

In one of the embodiments, the processing circuit includes a controller, a communication module, and a charging module, the controller is electrically connected to the communication module and the charging module respectively, the communication module is configured to communicate with an external device, the charging module is electrically connected to the battery and is configured to electrically connect an external charging device and charge the battery through the external charging device, the controller being is configured to receive the trigger signal and convert the trigger signal into an interactive signal, the interactive signal is sent by the communication module to the external device for interactive control, the controller, the communication module, and the charging module are arranged on a side of the flexible printed circuit board away from the second ring body, and the controller, the communication module, and the charging module are spaced apart along a circumferential direction of the flexible printed circuit board.

In one of the embodiments, the smart ring further includes a vital signs sensor arranged on the flexible printed circuit board and located between the communication module and the charging module, the first ring body is provided with a transparent window corresponding to the vital signs sensor, and the vital signs sensor is configured to emit and receive light through the transparent window to detect vital signs of the wearer.

In one of the embodiments, the charging module includes a wireless charging coil electrically connected to the battery and the controller, the charging coil is configured to be electrically inductive with the external charging device to serve as a charging receiving end, and a side of the flexible printed circuit board away from the charging coil is provided with a magnetic shielding layer.

In one of the embodiments, the trigger assembly includes a trigger switch and a pressing member, the trigger switch is arranged on a side of the flexible printed circuit board adjacent to the second ring body, and the first ring body is provided with a through hole, the pressing member is arranged in the first ring body and is at least partially exposed from the through hole, and the pressing member is configured to be pressed to abut against the trigger switch, so that the trigger switch generates the trigger signal.

In one of the embodiments, a plurality of through holes are provided, a plurality of pressing members are provided, a plurality of trigger switches are provided, the plurality of trigger switches are spaced apart along a circumferential direction of the flexible printed circuit board, the through holes, the pressing members, and the trigger switches are radially aligned in a one-to-one correspondence, the trigger switches have same functions or different functions, and a side surface of the second ring body is provided with identification marks corresponding to the functions of the trigger switches.

In one of the embodiments, the pressing member includes a plurality of supporting section, a plurality of connecting section, and a plurality of pressing section, each pressing section is connected to one supporting section, each supporting section is configured to abut against one trigger switch, each connecting section is connected between adjacent two supporting sections, the connecting sections and the supporting sections are located on a side of the pressing sections away from the through hole, and an area of each supporting section is larger than an area of the corresponding pressing section.

In one of the embodiments, each pressing section is located on a middle of the first ring body in a width direction thereof.

In one of the embodiments, the first ring body includes a first housing and a second housing cooperatively enclosing to form a first mounting cavity, the through hole is provided on the first housing, the processing circuit is arranged in the first mounting cavity, the trigger assembly is partially located in the first mounting cavity, the second housing is provided with the receiving hole configured to sleeve on the finger of the wearer, the second housing is sealingly connected to the first housing, and a portion of the pressing member located in the through hole is made of a flexible material.

In one of the embodiments, at least one of the first magnet and the second magnet has a ring structure defined by a plurality of arc structures, a central angle of each of the arc structures is greater than or equal to 72°.

In one of the embodiments, two groups of first magnets are spaced apart along a width direction of the first ring body, two groups of second magnets are spaced apart along a width direction of the second ring body, and at least one of the first magnet and the second magnet has a ring structure.

In one of the embodiments, the flexible printed circuit board further includes a first magnetic induction member and a second magnetic induction member that are electrically connected to a controller respectively, the smart ring further includes a plurality of first induction magnet, the first induction magnets are a plurality of strip magnets, the plurality of first induction magnets are spaced apart along a circumferential direction of the second ring body, the first induction magnets are located between the first magnets and the second magnets, and the first magnetic induction member and the second magnetic induction member are configured to be mutually inductive with the plurality of first induction magnets and form periodic signals.

The details of one or more embodiments of the present disclosure are set forth in the accompanying drawings and the description below. Other features, objects and advantages of the present disclosure will become apparent from the description, the accompanying drawings, and the claims.

BRIEF DESCRIPTION OF THE DRAWINGS

In order to more clearly illustrate the technical solutions in embodiments of the present disclosure or the prior art, the accompanying drawings used in the description of the embodiments or the prior art will be briefly introduced below. It is apparent that the accompanying drawings in the following description are only some embodiments of the present disclosure, and other drawings can be obtained by those of ordinary skill in the art from the provided drawings without creative efforts.

DESCRIPTION OF REFERENCE SIGNS

Figure 1:
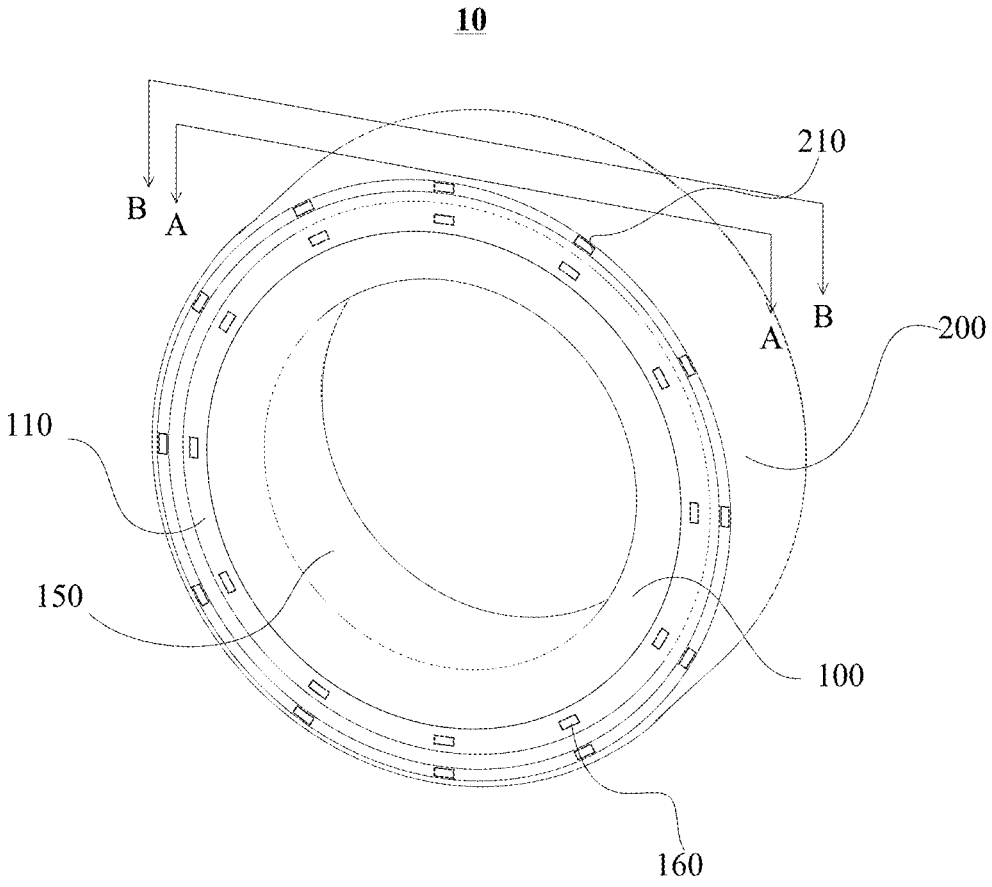
FIG. 1 is a perspective view of a smart ring according to an embodiment of the present disclosure.
Figure 2:
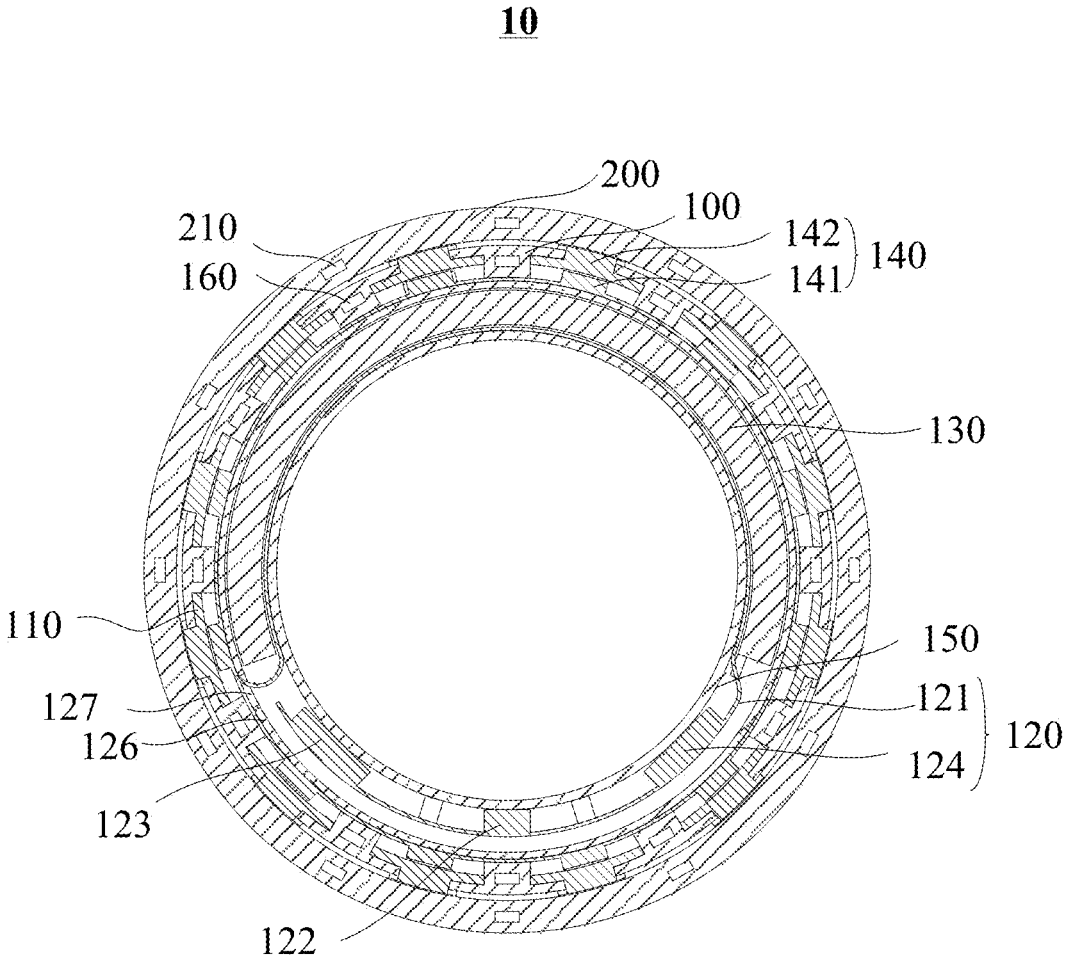
FIG. 2 is a cross-sectional view taken along the line A-A of FIG. 1.
Figure 3:
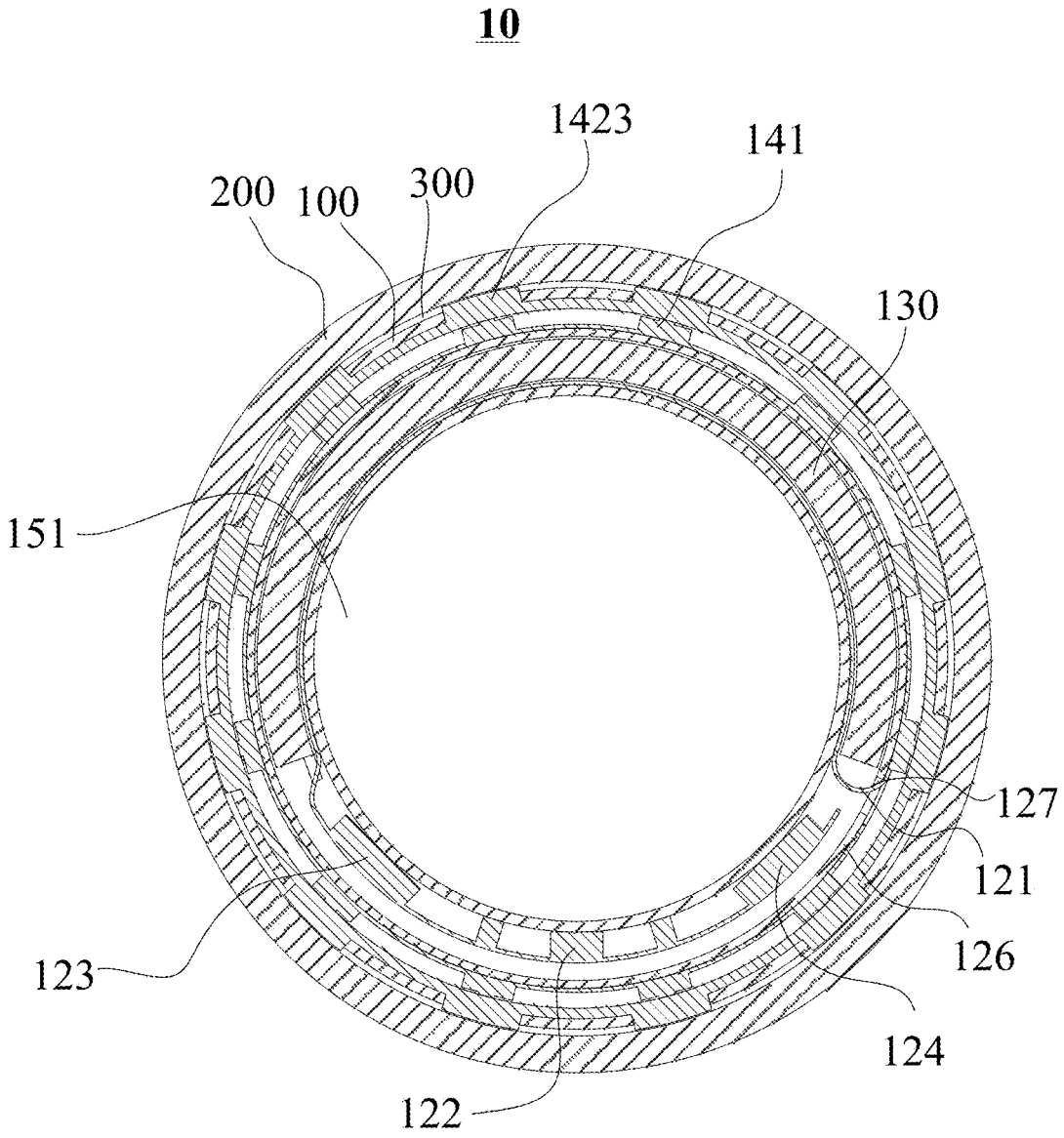
FIG. 3 is cross-sectional view taken along the line B-B of FIG. 1.
Figure 4:
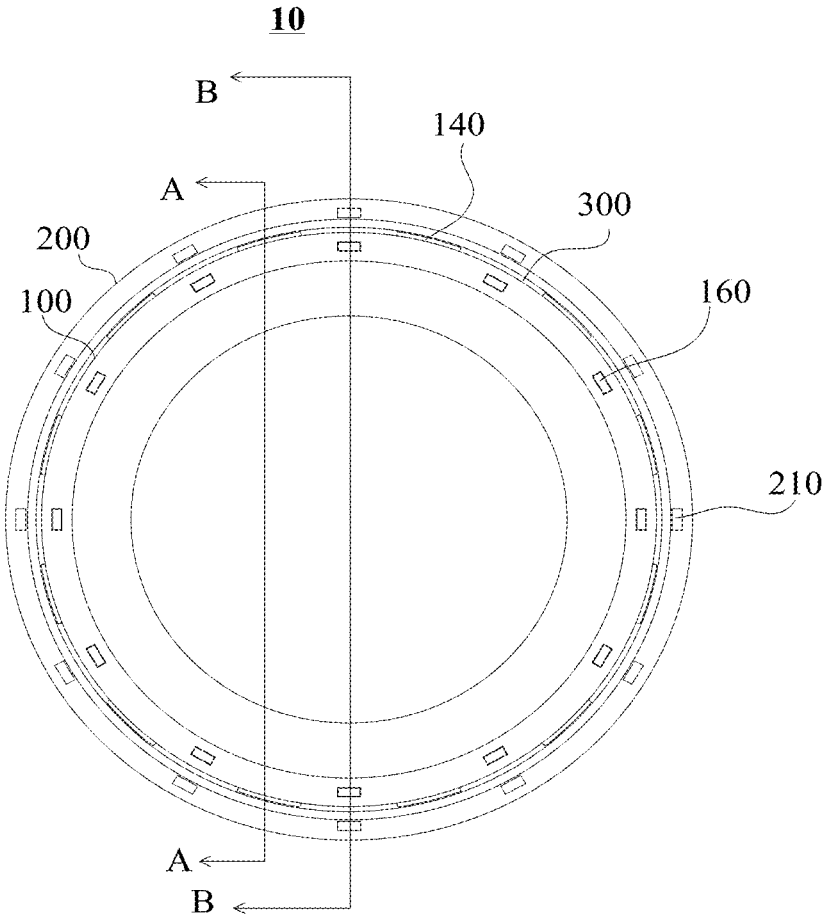
FIG. 4 is a front view of the smart ring in FIG. 1.
Figure 5:
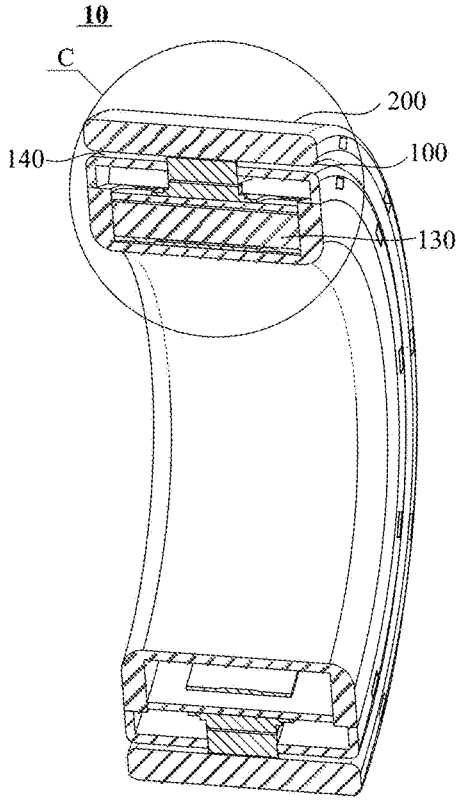
FIG. 5 is a cross-sectional perspective view along the line A-A of FIG. 4.

10: smart ring;

100: first ring body; 110: first housing; 111: first mounting cavity; 112: through hole; 113: first engaging portion; 114: second engaging portion; 115: first limiting groove; 116: second limiting groove; 117: first accommodating groove; 120: processing circuit; 121: flexible printed circuit board; 1211: first section; 1212: second section; 1213: connecting section; 122: vital signs sensor; 1221: first transmitting unit; 1222: second transmitting unit; 1223: receiving unit; 1224: light blocking section; 123: wireless charging coil; 124: communication module; 125: capacitive touch sensor; 126: mounting bracket; 127: mounting opening; 130: battery; 140: trigger assembly; 141: trigger switch; 142: pressing member; 1421: supporting section; 1422: connecting section; 1423: pressing section; 150: second housing; 151: receiving hole; 160: first magnet; 170: first magnetic induction member; 180: second magnetic induction member; 190: protruding portion;

200: second ring body; 210: second magnet; 220: second accommodating groove; 212: second induction magnet;

300: first gap; 310: first induction magnet.

DETAILED DESCRIPTION

To make the objectives, technical solutions, and advantages of the present disclosure clearer, the technical solutions in the present disclosure will be described clearly and completely below with reference to the accompanying drawings in the present disclosure. Apparently, the described embodiments are merely some of rather than all of the embodiments of the present disclosure. All other embodiments acquired by those skilled in the art without creative efforts based on the embodiments of the present disclosure shall fall within the protection scope of the present disclosure.

In the description of the embodiments of the present disclosure, it is to be understood that the orientation or position relationships indicated by the terms "central", "longitudinal", "transverse", "upper", "lower", "front", "back", "left", "right", "vertical", "horizontal", "top", "bottom", "inner", "outer", and the like are based on the orientation or position relationships shown in the accompanying drawings and are intended to facilitate the description of the present disclosure and simplify the description only, rather than indicating or implying that the apparatus or element referred to must have a particular orientation or be constructed and operated in a particular orientation, and therefore are not to be interpreted as limiting the embodiments of the present disclosure. In addition, the terms "first", "second", and "third" are used for descriptive purposes only, which cannot be construed as indicating or implying a relative importance.

In the description of the embodiments of the present disclosure, unless otherwise specified and defined explicitly, the terms "join" and "connect" should be understood in a broad sense, which may be, for example, a fixed connection, a detachable connection, or an integral connection; a mechanical connection or an electrical connection; or a direct connection, or an indirect connection via an intermediate medium. Those of ordinary skill in the art can understand specific meanings of these terms in the embodiments of the present disclosure according to specific situations.

In the embodiments of the present disclosure, unless otherwise explicitly specified and defined, the expression a first feature being "on" or "under" a second feature may be the case that the first feature is in direct contact with the second feature, or the first feature is in indirect contact with the second feature via an intermediate medium. Furthermore, the expression the first feature being "over", "above" and "on top of" the second feature may be the case that the first feature is directly above or obliquely above the second feature, or only means that the level of the first feature is higher than that of the second feature. The expression the first feature being "below", "underneath" or "under" the second feature may be the case that the first feature is directly underneath or obliquely underneath the second feature, or only means that the level of the first feature is lower than that of the second feature.

In the description of the specification, reference terms such as "an embodiment", "some embodiments", "an example", "a specific example", and "some examples" mean that a particular feature, structure, material, or characteristic described in connection with the embodiment or example is included in at least one embodiment or example of the embodiments of the present disclosure. In the specification, the schematic expressions to the above terms are not necessarily referring to the same embodiment or example. In addition, the described features, structures, materials, or characteristics may be combined in one or more embodiments or examples in any appropriate manner. Furthermore, those skilled in the art may combine different embodiments or examples and features of the different embodiments or examples described in this specification without mutual contradiction.

Referring to FIG. 1 to FIG. 13, a smart ring 10 is provided according to the present disclosure.

In view of the fact that conventional wearable devices have a relatively monotonous shape and structure and are inconvenient for users to control, the present disclosure provides a smart ring 10, including a first ring body 100, a second ring body 200, a trigger assembly 140, and a processing circuit 120.

Referring to FIG. 1 to FIG. 7, the first ring body 100 is configured to accommodate a finger of a wearer, the second ring body 200 sleeve on a periphery of the first ring body 100, and a first gap 300 is formed between the first ring body 100 and the second ring body 200 in a circumferential direction of the smart ring 10. The trigger assembly 140 is arranged on the first ring body 100 and is at least partially exposed from the first ring body 100. The processing circuit 120 is arranged on the first ring body 100 and is electrically connected to the trigger assembly 140. In the embodiment, the first ring body 100 and the second ring body 200 are capable of rotating with each other along the first gap 300. The second ring body 200 is further movable in a radial direction of the smart ring 10 relative to the first ring body 100. When a user presses the second ring body 200, the second ring body 200 may receive a force of the user and move towards the first ring body 100. An inner side of the second ring body 200 may abut against a portion of the trigger assembly 140 exposed from the first ring body 100, thereby driving the trigger assembly 140 to generate a trigger signal. The processing circuit 120 is configured to convert the trigger signal into an interactive signal, so as to achieve intelligent interaction with other smart devices. Specifically, functions of the other smart devices may be controlled or selected. According to the smart ring 10, the smart ring 10 can be worn on a finger of the user, which is small in size and can be worn easily without causing any feeling of strangeness. The two ring bodies are allowed to rotate with each other, which provides playability and stress relief effects. A pressing action can be accurately detected through the trigger assembly 140 and the interactive instruction can be generated. The smart ring 10 effectively integrates playability, decoration, and intelligent interaction, greatly improving application scenarios of the product.

Since the first ring body 100 and the second ring body 200 are configured to be allowed to rotate with each other along the first gap 300, the first ring body 100 worn on the finger of the user may be fixed to some extent, while the second ring body 200 may fall off due to movable arrangement. In order to ensure stable wearing of the second ring body 200, referring to FIG. 10, in the embodiment, the first ring body 100 is provided with a protruding portion 190. Along the width direction of the first ring body 100, the protruding portion 190 is blocked at an edge of the second ring body 200. When the second ring body 200 has a tendency to fall off, the protruding portion 190 can block the second ring body 200, so as to prevent the second ring body 200 from falling off. In an embodiment, the protruding portion 190 may be arranged in a circle along a circumferential direction of the first ring body 100, which is annular. In another embodiment, a plurality of protruding portions 190 are provided on the fingertip side of the first ring body 100, and the plurality of protruding portions 90 are spaced apart along the circumferential direction of the first ring body 100.

In an embodiment, the second ring body 200 may directly sleeve the periphery of the first ring body 100, and the second ring body 200 is fixed by the protruding portion 190 to prevent the second ring body 200 from falling off. In order to further improve the playability and also to further enhance a combined effect of the first ring body 100 and the second ring body 200, the smart ring 100 further includes a first magnet 160 circumferentially provided on the first ring body 100 and a second magnet 210 circumferentially provided on the second ring body 200. The trigger assembly 140 is spaced apart from the first magnet 160 and the second magnet 210. The first ring body 100 is configured to be rotatable relative to the second ring body 200, and the first ring body 100 and the second ring body 200 are spaced apart in the radial direction under mutual magnetic force between the first magnet 160 and the second magnet 210. That is, the first ring body 100 and the second ring body 200 can remain relatively stable under the magnetic force, and the first gap 300 is formed between the first ring body 100 and the second ring body 200 to maintain a magnetic levitation state.

In an embodiment, a magnetic pole of a side of the first magnet 160 facing the second ring body 200 is the same as a magnetic pole of a side of the second magnet 210 facing the first ring body 100. In an embodiment, the magnetic pole of the side of the first magnet 160 facing the second ring body 200 is an N pole, the magnetic pole of the side of the second magnet 210 facing the first ring body 100 is also an N pole, so that the magnetic poles of the first magnet 160 and the second magnet 210 repel each other. It should be noted that in a stable state, the first magnet 160 and the second magnet 210 are misaligned, and under the magnetic force, gravity and other component forces, the first ring body 100 and the second ring body 200 can maintain the magnetic levitation state. If the user rotates the second ring body 200, when the first magnet 160 on the first ring body 100 and the second magnet 210 on the second ring body 200 approach each other, the second ring body 200 may first rotates quickly and then slowly until the second magnet 210 is aligned with the first magnet 160. which can bring a sense of blocking, thereby increasing hand feel. In another embodiment, the magnetic pole of the side of the first magnet 160 facing the second ring body 200 is different from the magnetic pole of the side of the second magnet 210 facing the first ring body 100. In an embodiment, the magnetic pole of the side of the first magnet 160 facing the second ring body 200 is an S pole, the magnetic pole of the side of the second magnet 210 facing the first ring body 100 is an N pole, so that the magnetic poles of the first magnet 160 and the second magnet 210 attract each other, which can achieve attraction and fixation effects.

In some embodiments, a plurality of first magnets 160 and a plurality of second magnets 210 are provided. The plurality of first magnets 160 are spaced apart along the circumferential direction of the first ring body 100, and a first spacing is formed between adjacent two first magnets 160. The plurality of second magnets 210 are spaced apart along the circumferential direction of the second ring body 200, a second spacing is formed between adjacent two second magnets 210. The first magnet 160 extends axially along the first ring body 100, and the second magnet 210 extends axially along the second ring body 200. In another embodiment, the magnetic poles of sides of the first magnet 160 and the second magnet 210 that are opposite to each other may be alternately configured to be the same or different. For example, magnetic poles of the side of the first ring bodies 100 facing the second ring body 200 are sequentially configured to an S pole, an N pole, an S pole, an N pole, etc., and magnetic poles of the side of the second ring body 200 facing the first ring body 100 are sequentially configured to an N pole, an N pole, an N pole, an N pole, etc. By alternately configuring the magnetic poles to be the same and different, the user may have a sense of blocking with the changes in resistance during the rotation, increasing the hand feel and diverting attention of the user.

Numbers of the first magnet 160 and the second magnet 210 may be set according to sizes of the first magnet 160 and the second magnet 210 and an actual situation, such as 4, 6, 8, or 11. The numbers of the first magnet 160 and the second magnet 210 may be the same or different. The number of the first magnet 160 may be greater than the number of the second magnet 210 or less than the number of the second magnet 210. The number of the first magnet 160 and the number of the second magnet 210 may be proportional. In an embodiment, a central angle corresponding to the first spacing is the same as a central angle corresponding to the second spacing. That is, the first magnets 160 and the second magnets 210 are arranged in a one-to-one correspondence. In another embodiment, the central angle corresponding to the first spacing is different from the central angle corresponding to the second spacing, so that the user can have different blocking senses during the rotation.

Figure 15:
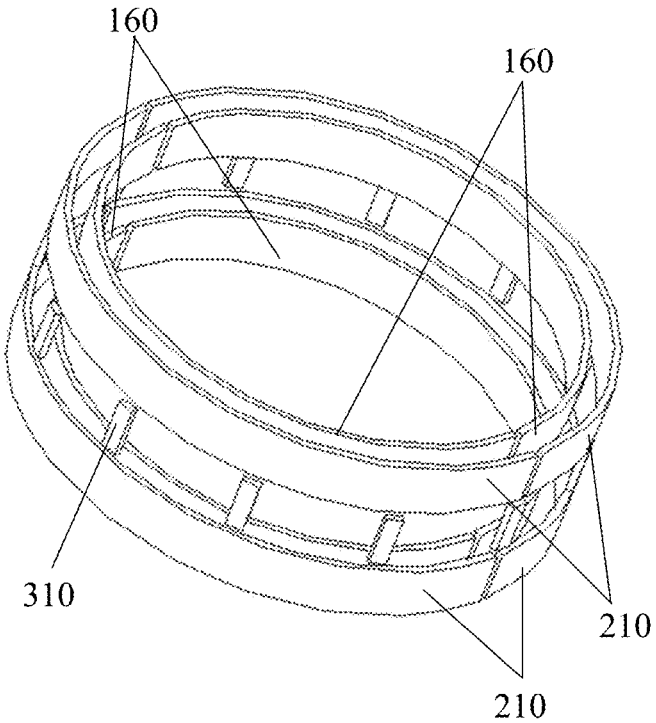
FIG. 15 is a perspective view of a first magnet, a second magnet, and an induction magnet according to another embodiment of the present disclosure.
Figure 16:
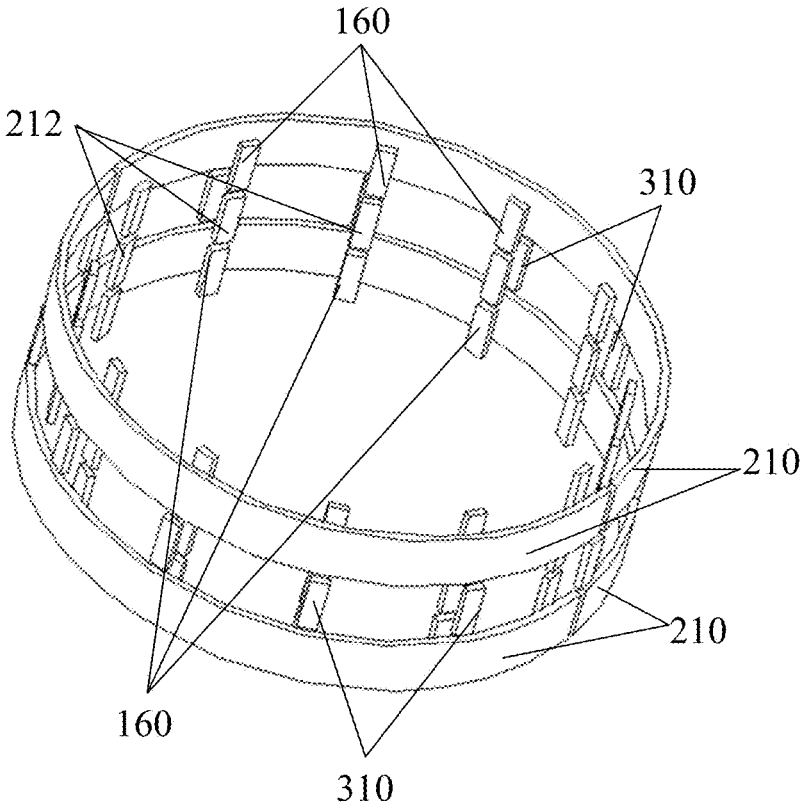
FIG. 16 is a perspective view of a first magnet, a second magnet, and an induction magnet according to yet another embodiment of the present disclosure.
Figure 17:
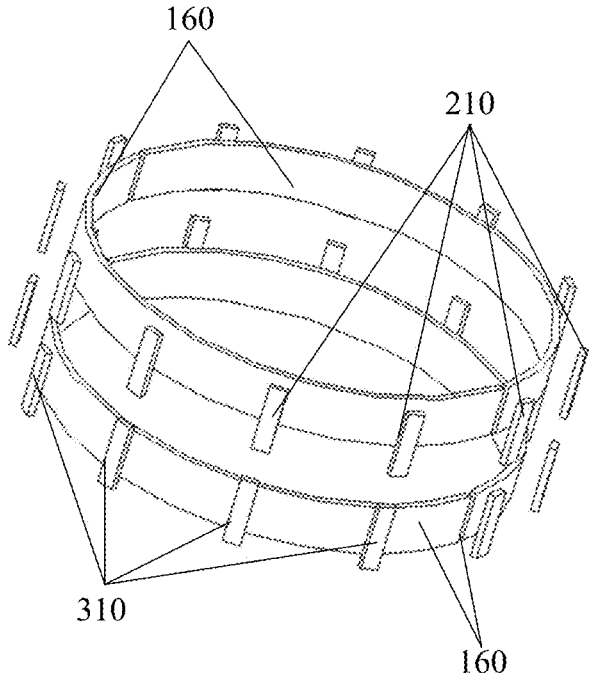
FIG. 17 is a perspective view of a first magnet, a second magnet, and an induction magnet according to still another embodiment of the present disclosure.

In some embodiments, referring to FIG. 15 to FIG. 17, at least one of the first magnet 160 and the second magnet 210 has a ring structure defined by a plurality of arc structures. A central angle of each of the arc structures is greater than or equal to 72°, such as 72°, 90°, or 180°. If the ring structure is defined by magnets of five arc structures, the central angle of each arc structure is 72°. In another embodiment, referring to FIG. 15 and FIG. 16, the ring structure is defined by magnets of two arc structures, and the central angle of each the arc structure is 180°.

In some embodiments, to facilitate understanding of a position and a structural relationship of each magnet, the first ring body 100 and the second ring body 200 are omitted in FIG. 14 to FIG. 17 and only the position and the structural relationship of the first magnets 160 and the second magnets 210 are shown for description. Referring to FIG. 14 to FIG. 17, two groups of first magnets 160 are spaced apart along a width direction of the first ring body 100, and each group of first magnets 160 is arranged along the circumferential direction of the first ring body 100. Two groups of second magnets 210 are spaced apart along a width direction of the second ring body 200, and each group of second magnets 210 is arranged along the circumferential direction of the second ring body 200. At least one of the first magnet 160 and the second magnet 210 has a ring structure. It may be understood that the width direction of the first ring body 100 may be an axial direction of the first ring body 100, and the width direction of the second ring body 200 may be an axial direction of the second ring body 200. Each group of first magnets 160 correspond to the second magnets 210 in the circumferential direction, for example, the first magnet 160 and the second magnet 210 are arranged as inner and outer concentric circles. The smart ring 10 may further includes a plurality of first induction magnets 310 provided between the two groups of first magnets 160 in the width direction. The first induction magnets 310 may be strip-shaped magnets. The first induction magnets 310 are spaced apart along the circumferential direction of the second ring body 200, such as evenly spaced apart. In some embodiments, referring to FIG. 15, both the first magnet 160 and the second magnet 210 have ring structures. In some other embodiments, referring to FIG. 16 and FIG. 17, one of the first magnet 160 and the second magnet 210 may have a ring structure, the ring structure may be a ring structure formed by arcs or a complete ring structure, and the other one of the first magnet 160 and the second magnet 210 has a strip-shaped structure.

Figure 6:
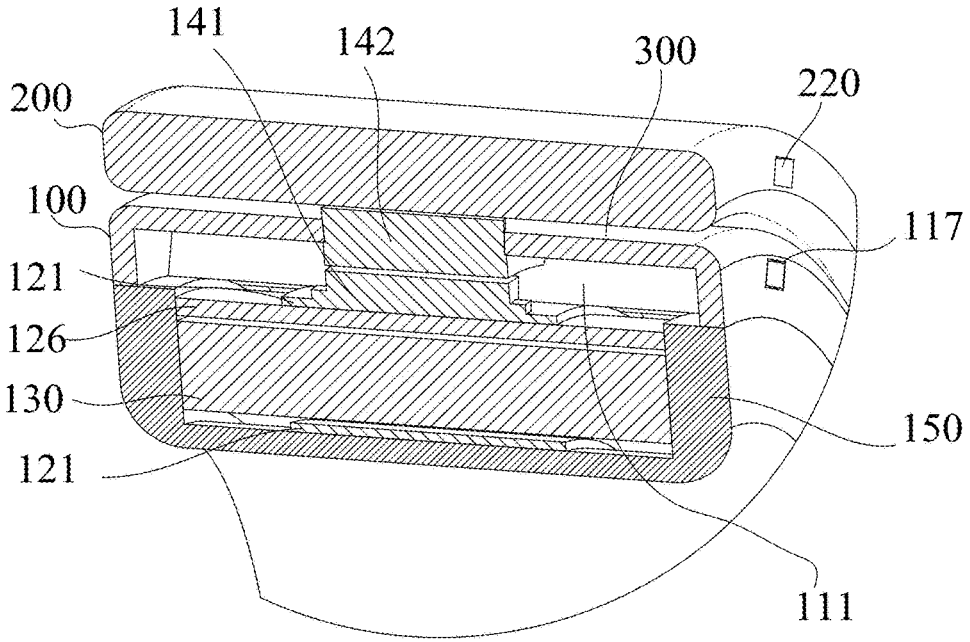
FIG. 6 is an enlarged view the circled portion C of FIG. 5.
Figure 7:
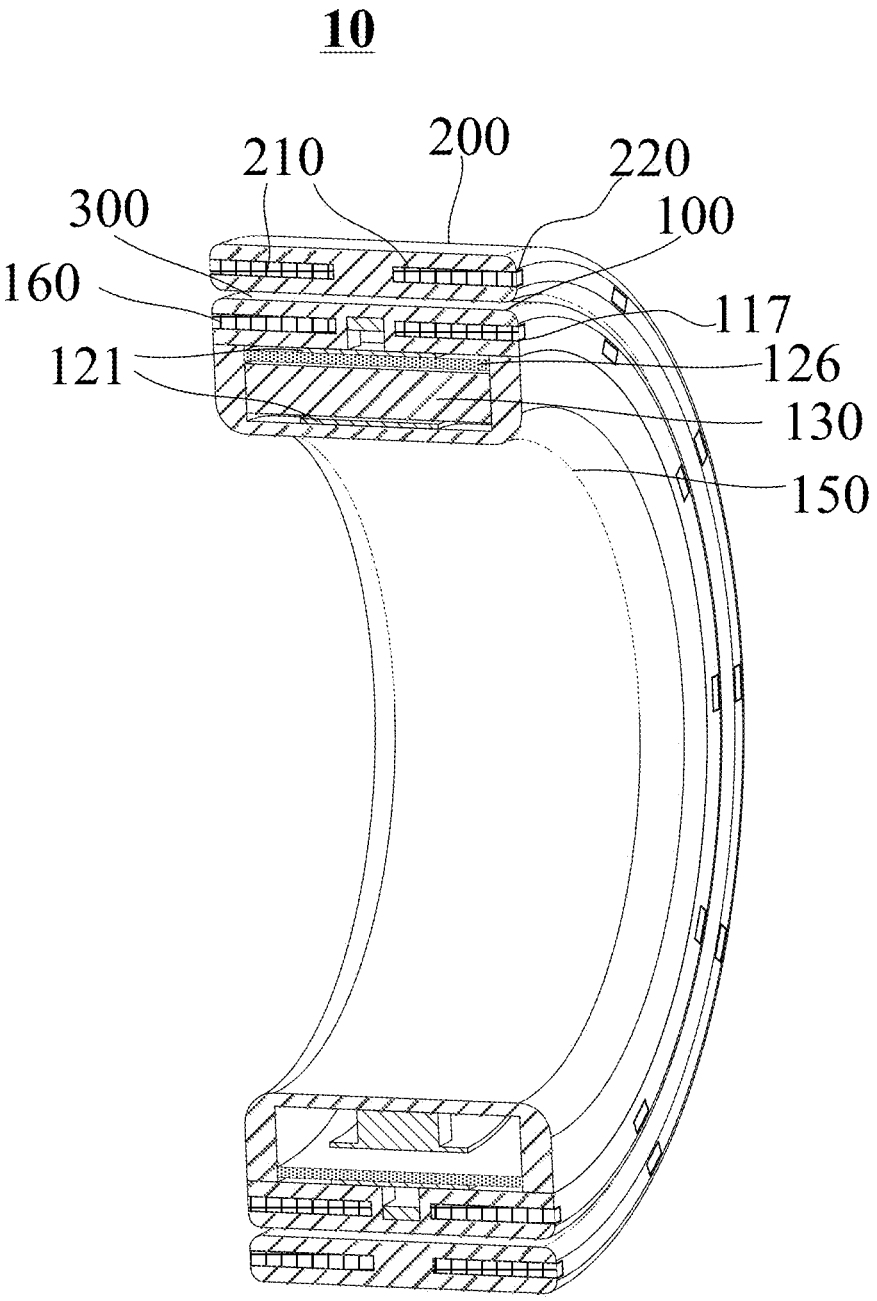
FIG. 7 is is a cross-sectional perspective view along the line B-B of FIG. 4.

In some other embodiments, referring to FIG. 16, in order to ensure stability of the magnetic force, the smart ring 10 may further includes a second induction magnet 212 provided on the first ring body 100 and magnetically inductive with the first induction magnet 310. The second induction magnet 212 may also be a strip-shaped magnet, and a polarity of the second induction magnet 212 may be the same as or different from the first induction magnet 310. Referring to FIGS. 6 and 7, in order to facilitate the mounting of the first magnet 160 and the second magnet 210, the first ring body 100 is circumferentially provided with a plurality of first accommodating grooves 117, each first accommodating groove 117 extends axially along the first ring body 100, and the first magnet 160 is detachably inserted into the first accommodating groove 117. The second ring body 200 is provided with a plurality of second accommodating grooves 220, each second accommodating groove 220 extends axially along the second ring body 200, and the second magnet 210 is detachably inserted into the second accommodating groove 220. In an embodiment, an opening of the first accommodating groove 117 is arranged outwards; and/or an opening of the second accommodating groove 220 is arranged outwards. By arranging the openings of the first accommodating groove 117 and the second accommodating groove 220 outwards, the user can replace the first magnet 160 and the second magnet 210 without disassembling the first ring body 100 or the second ring body 200 and adjust a rotation effect, such as rotation strength, which is more efficient. In order to improve a use effect, the first accommodating grooves 117 have different sizes; and/or the second accommodating grooves 220 have different sizes. Through the arrangement of the first accommodating grooves 117 and the second accommodating grooves 220 with different sizes, the first magnet 160 and the second magnet 210 with different sizes or shapes can be conveniently mounted, thereby improving user experience.

In some embodiments, referring to FIG. 8 to FIG. 12, the smart ring 10 further includes a mounting bracket 126, a flexible printed circuit board 121, and a battery 130. The flexible printed circuit board 121 is bent and surrounds the mounting bracket 126. The battery 130 is electrically connected to the flexible printed circuit board 121. The processing circuit 120 is arranged on the flexible printed circuit board 121. The battery 130 is located in a space formed by bending of the flexible printed circuit board 121. On the one hand, the flexible printed circuit board 121 that is bent is small in size and can be adapted to a shape of the smart ring 10, so that a size of the smart ring 10 does not increase additionally, which becomes more compact and exquisite. On the other hand, a mounting area can be increased, and more mounting space can be provided in the case of a same volume, which is conducive to an arrangement of components.

Figure 11:
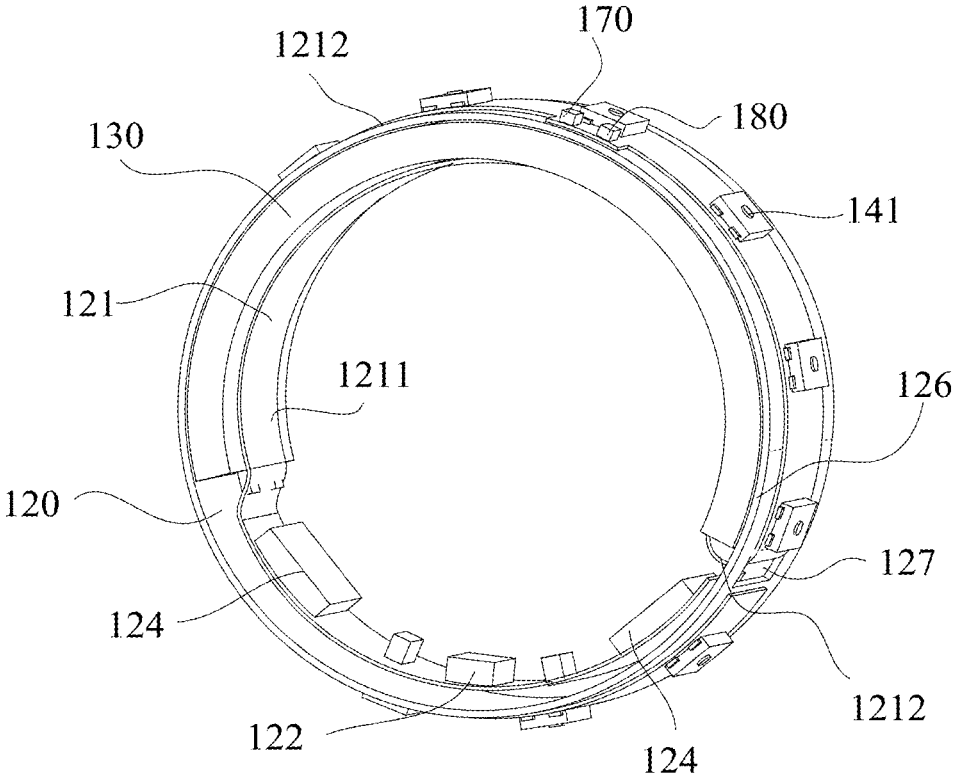
FIG. 11 is a perspective view illustrating a flexible printed circuit board assembled to a mounting bracket in FIG. 1.

Referring to FIG. 11, in some embodiments, the processing circuit 120 includes a controller, a communication module 124, and a charging module. The controller is electrically connected to the communication module 124 and the charging module, respectively. The communication module 124 is configured to communicate with an external device, such as a mobile phone, a tablet computer, a desktop computer, a near-eye display device (such as smart glasses), a projection device, etc. The charging module is electrically connected to the battery 130 and is configured to electrically connect an external charging device and charge the battery 130 through the external charging device. The controller is configured to receive the trigger signal and convert the trigger signal into an interactive signal, and the interactive signal is sent by the communication module 124 to the external device for interactive control. The controller, the communication module 124, and the charging module are arranged on a side of the flexible printed circuit board 121 away from the second ring body 200, and the controller, the communication module 124, and the charging module are spaced apart along a circumferential direction of the flexible printed circuit board 121.

Figure 12:
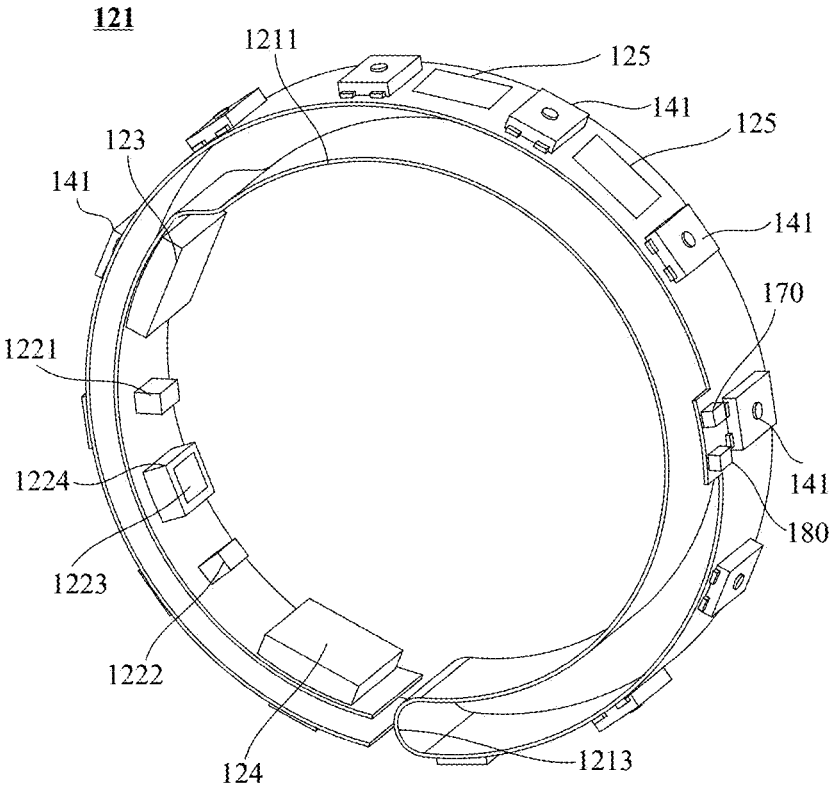
FIG. 12 is a perspective view of the flexible printed circuit board in FIG. 1.
Figure 13:
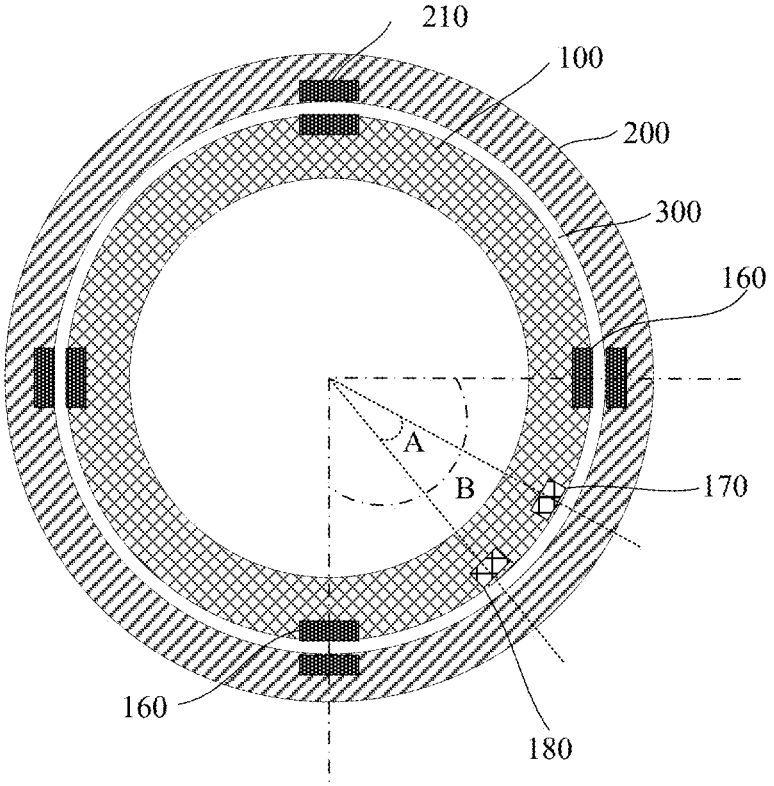
FIG. 13 is a schematic view of positions of a first magnetic induction member and a second magnetic induction member according to an embodiment of the present disclosure.
Figure 14:
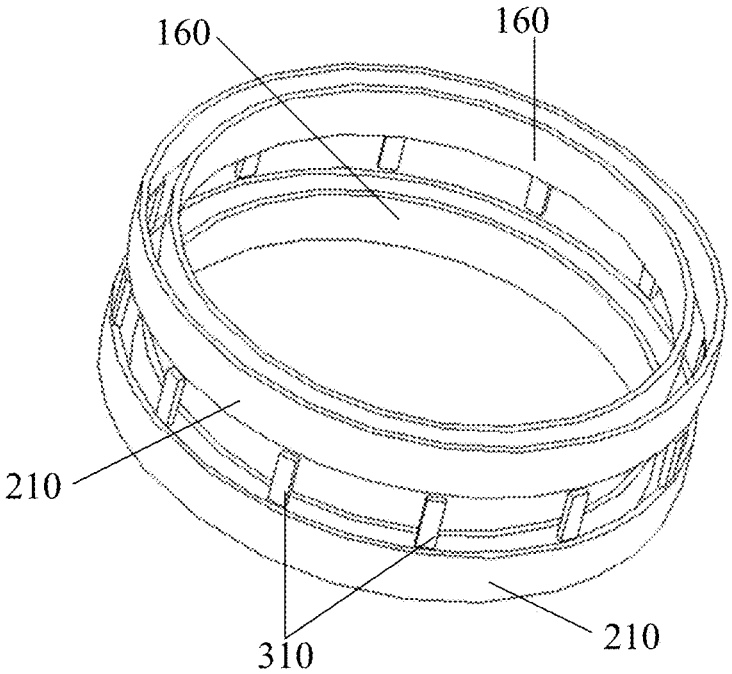
FIG. 14 is a perspective view of a first magnet, a second magnet, and an induction magnet according to an embodiment of the present disclosure.

Referring to FIG. 11 and FIG. 12, in some embodiments, the smart ring 10 includes a vital signs sensor 122, arranged on the flexible printed circuit board 121 and located between the communication module 124 and the charging module. The first ring body 100 is provided with a transparent window corresponding to the vital signs sensor 122, and the vital signs sensor 122 is configured to emit and receive light through the transparent window to detect vital signs of the wearer. The vital signs may include a heart rate, blood oxygen, blood pressure, a temperature, and etc. In an embodiment, the vital signs sensor 122 includes a first transmitting unit 1221, a second transmitting unit 1222, a receiving unit 1223, and a light blocking section 1224 that are located between the communication module 124 and the charging module. The receiving unit 1223 is located between the first transmitting unit 1221 and the second transmitting unit 1222, and the light blocking section 1224 is located between the first transmitting unit 1221 and the receiving unit 1223 and between the second transmitting unit 1222 and the receiving unit 1223. The light blocking section 1224 can block optical crosstalk, so as to ensure an accurate detection effect of the vital signs sensor 122.

In an embodiment, the charging module includes a wireless charging coil 123 electrically connected to the battery 130 and the controller. The wireless charging coil 123 is configured to be electrically inductive with the external charging device to serve as a charging receiving end. A side of the flexible printed circuit board 121 away from the wireless charging coil 123 is provided with a magnetic shielding layer. It should be noted that the wireless charging coil 123 can be located an inner side or an outer side of the smart ring 10. In an embodiment, considering that the wireless charging coil 123 arranged on the outer side may cause inconvenience in charging, the wireless charging coil 123 is located on the inner side of the smart ring 10. In this way, the wireless charging coil 123 can be adapted to a columnar or plate-shaped wireless charging device to achieve convenient and quick charging effect. In other embodiments, the flexible printed circuit board 121 includes metal contacts, and no wireless charging coil may be provided. The metal contacts are electrically connected to the battery 130, and the external charging device may include a wired charging head configured to be electrically connected to the metal contacts to charge the battery 130.

In an embodiment, referring to FIG. 11 to FIG. 12, the flexible printed circuit board 121 includes a first section 1211, a second section 1212 spaced apart from and surrounding the first section 121, and a middle connecting section 1213 connected between ta tail end of the first section 1211 and a head end of the second section 1212. The middle connecting section 1213 is substantially perpendicular to the tail end of the first section 1211, and the tail end of the first section 1211, the middle connecting section 1213, and the head end of the second section 1212 form a U-shape. A side of the first section 1211 away from the second section 1212 forms an inner side of the flexible printed circuit board 121 (i.e., a side of the of the flexible printed circuit board 121 away from the second ring body 200), and a side of the second section 1212 away from the first section 1211 forms an outer side of the flexible printed circuit board 121 (i.e., a side of the of the flexible printed circuit board 121 adjacent to the second ring body 200). That is, the flexible printed circuit board 121 is bent twice to form the first section 1211, the second section 1212, and the middle connecting section 1213. The controller, the charging module, the vital signs sensor 122, and the communication module 124 are arranged on the first section 1211, and the trigger assembly 140 is arranged corresponding to the second section 1212. The mounting bracket 126 is provided with a mounting opening 127. When the flexible circuit board 121 is mounted on the mounting bracket 126, the first section 1211 is arranged on an inner side of the mounting bracket 126, the second section 1212 extends through the mounting opening 127 and is arranged on an outer side of the mounting bracket 126, and the connecting middle section 1213 is received in the mounting opening 127. On the one hand, the mounting bracket 126 can facilitate the mounting of the flexible printed circuit board 121, and on the other hand, the mounting bracket 126 can prevent the flexible printed circuit board 121 from being deformed.

Figure 9:
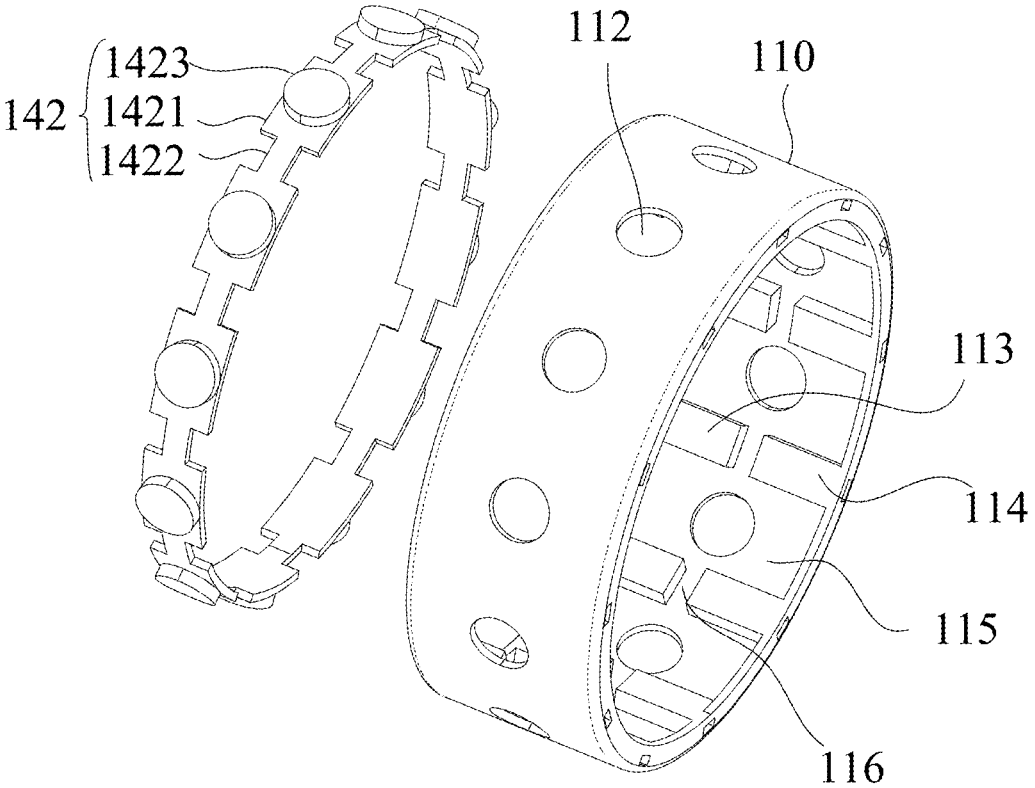
FIG. 9 is an exploded view of the first ring body of FIG. 8.
Figure 10:
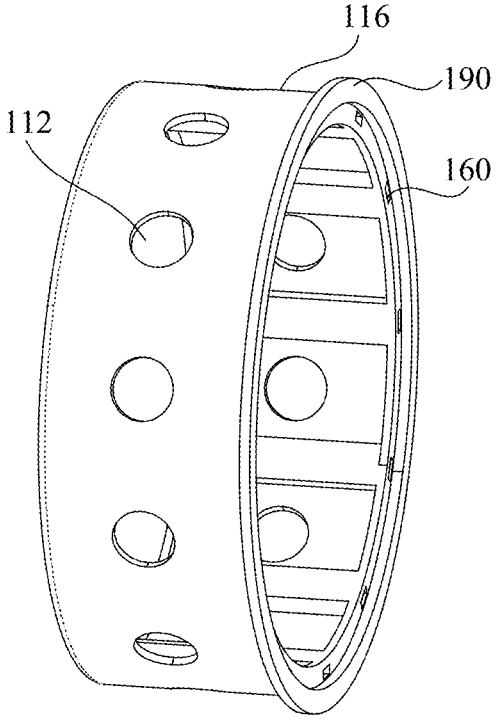
FIG. 10 is a perspective view of a first housing according to an embodiment.

Specifically, referring to FIGS. 9 to 11, the trigger assembly 140 includes a trigger switch 141 and a pressing member 142. The trigger switch 141 is arranged on a side of the flexible printed circuit board 121 adjacent to the second ring body 200. The first ring body 100 is provided with a through hole 112, and the pressing member 142 is arranged in the first ring body 100 and is at least partially exposed from the through hole 112. The pressing member 142 is configured to be pressed to abut against the trigger switch 141, so that the trigger switch 141 generates the trigger signal. The trigger switch 141 may be a micro switch, a switch contact, etc. The pressing member 142 has a certain degree of freedom. The user can trigger the trigger switch 141 by touching a portion of the pressing member 142 that is exposed from the through hole 112 pressing member. Compared with the touch screen or complex buttons in the conventional art, a control effect can be achieved by pressing the touch control part 142, and the control logic is simpler. It should be noted that when the second ring body 200 is mounted, the pressing member 142 may be pressed through an inner side of the second ring body 200, and when the second ring body 200 is removed, the pressing member 142 can be directly pressed manually.

It should be noted that one or more trigger switches 141 may be provided. When one trigger switch 141 is provided, different times of triggering of the trigger switch 141 may correspond to different control functions. In some embodiments, a plurality of through holes 112 are provided, a plurality of pressing members 142 are provided, and a plurality of trigger switches 141 are provided. The plurality of trigger switches 141 are spaced apart along a circumferential direction of the flexible printed circuit board 121, and the through holes 112, the pressing members 142, and the trigger switches 141 are radially aligned in a one-to-one correspondence. By arranging the plurality of trigger switches 141, it is convenient for the user to perform trigger operations at various positions of the ring, and the operation is simpler. It should be noted that the trigger switches 141 may have same functions, and a same control effect can be achieved through the pressing member 142 at any position. Alternatively, the trigger switches 141 may have different functions, and different control effects can be achieved though the pressing member 142 at different positions. Furthermore, When the trigger switches 141 have different functions, a side surface of the second ring body 200 is provided with identification marks corresponding to the functions of the trigger switches 141, so as to facilitate the user to view and select.

In order to further improve convenience of the operation, referring to FIG. 12, the flexible printed circuit board 121 further includes a capacitive touch sensor 125 located between adjacent two trigger switches 141. It should be noted that one capacitive touch sensor 125 may be arranged between each two trigger switches 141, or the capacitive touch sensor 125 may be arranged between partial trigger switches 141. It should be noted that the capacitive touch sensor 125 is configured to detect an action input of the user and convert the action input into an interactive signal by the controller, and the communication module 124 transmits the interactive signal to the external device. In an embodiment, in order to facilitate control, one capacitive touch sensor 125 is arranged between each adjacent two trigger switches 141. In order to reduce difficulty of the operation, parameters of each capacitive touch sensor 125 are the same. When a same touch operation is applied to each capacitive touch sensor 125, control signals expressed are the same. In an embodiment, the touch operation includes a click operation, a sliding operation, etc., which correspond to different control signals.

Figure 8:
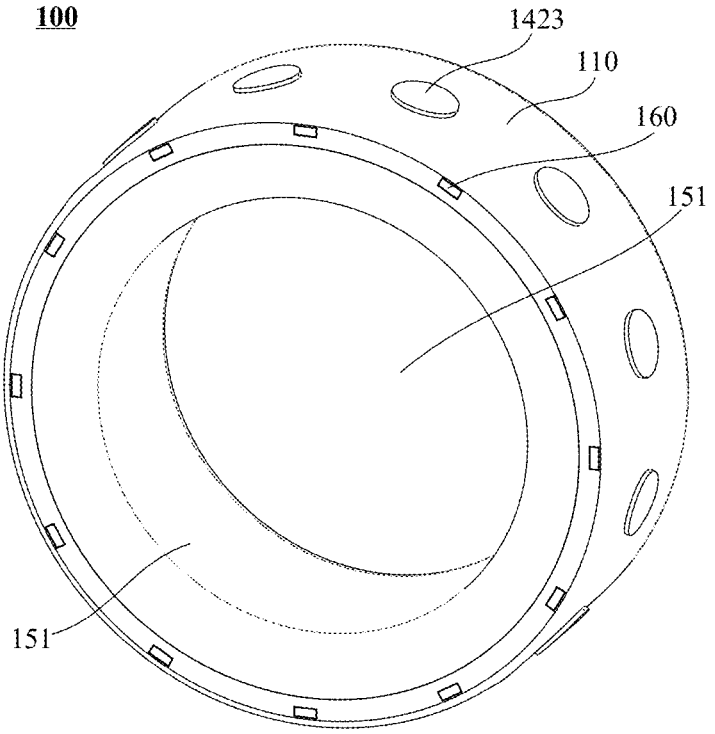
FIG. 8 is a perspective view of a first ring body according to an embodiment.

In some embodiments, referring to FIG. 8 to FIG. 9, the pressing member 142 includes a plurality of supporting section 1421, a plurality of connecting sections 1422, and a plurality of pressing section 1423. Each pressing section 1423 is connected on one supporting section 1421, each supporting section 1421 is configured to abut against one trigger switch 141, and each connecting section 1422 is connected between adjacent two supporting sections 1421. The connecting section 1422 and the supporting section 1421 are located on a side of the pressing sections 1423 away from the through hole 112, and an area of the supporting section 1421 is greater than an area of the corresponding pressing section 1423. Through the arrangement of the supporting section 1421, a contact area between the pressing member 142 and the trigger switch 141 can be increased, which facilitates triggering the trigger switch 141 and is less likely to cause touch failure. Further, due to the arrangement of the connecting section 1422, the entire pressing member 142 is formed as a whole, which can be easily mounted. In order to prevent the pressing member 142 from rotating, limiting mounting thereof is required. Specifically, an inner wall of the first ring body 100 is provided with a plurality of first engaging portions 113 and a plurality of second engaging portions 114. The plurality of first engaging portions 113 and the plurality of second engaging portions 114 are spaced apart along the circumferential direction of the first ring body 100, respectively to form first limiting grooves 115 located between adjacent first engaging portions 113 or adjacent second engaging portions 114. The plurality of first engaging portions 113 and the plurality of second engaging portions 114 are opposite to each other in a one-to-one correspondence in a radial direction of the first ring body 100. A second limiting groove 116 is formed between each pair of the first engaging portion 113 and the second engaging portion 114 that are opposite to each other. The through hole 112 is in communication with the first limiting groove 115, and the supporting section 1421 is located in the first limiting groove 115. The connecting section 1422 is located in the second limiting groove 116, and the first engaging portion 113 and the engaging portions 114 limit an axial movement of the connecting section 1422. In an embodiment, the first limiting groove 115 is in communication with the second limiting groove 116. Through the arrangement of the first engaging portion 113 and the second engaging portion 114, on the one hand, the pressing member 142 can be mounted, and on the other hand, the pressing member 142 can be limited to prevent an influence of rotation thereof on the use effect.

In some embodiments, in order to facilitate use control by the user, when each pressing section 1423 is arranged in the corresponding through hole 112, each pressing section 1423 is located on a middle of the first ring body 100 in a width direction thereof. The pressing section 1423 may extend out of the through hole 112. In this way, the pressing section 1423 can be pressed conveniently.

Referring to FIG. 1 and FIGS. 6 to 9, in some embodiments, the first ring body 100 includes a first housing 110 and a second housing 150 cooperatively enclosing to form a first mounting cavity 111. The through hole 112 is provided on the first housing 110. The processing circuit 120 is arranged in the first mounting cavity 111, and the trigger assembly 140 is partially located in the first mounting cavity 111. The second housing 150 is provided with a receiving hole 151 configured to sleeve on a finger of the wearer. It should be noted that the second housing 150 is sealingly connected to the first housing 110, and a portion of the pressing member 142 located in the through hole 112 is made of a flexible material, such as silicone or plastic. In this way, the sealing performance of the smart ring 10 can be ensured and the service life of the smart ring 10 can be prolonged. In addition, the waterproofness of the smart ring 10 is also improved. The smart ring 10 can also be used normally when the user's skin is sweaty or in rain or snow weather, which significantly improves the user experience.

In some embodiments, the first housing 110 surrounds an outer side of the second housing 150. The first housing 110 and the second housing 150 are made of different materials, and a strength of the first housing 110 is greater than that of the second housing 150. The second housing 150 is made of epoxy resin. Epoxy resin may be injection-molded on the first housing 110 to form the second housing 150, and then the second housing 150 may be polished to ensure a smooth surface thereof. The epoxy resin has certain strength and light transmittance, which facilitates mounting of a light sensing component such as the vital signs sensor 122. Certainly, epoxy resin or sealing glue may be provided between the first housing 110 and the second housing 150. In other embodiments, an elastic sealing ring may be arranged between the first housing 110 and the second housing 150, which can improve the sealing performance of the first ring body 100 and reduce a risk of damage to the electrical components caused by infiltration of liquid into the first ring body 100.

In some embodiments, referring to FIG. 11 to FIG. 17, the flexible printed circuit board 121 further includes a first magnetic induction member 170 and a second magnetic induction member 180 that are electrically connected to the controller respectively. The smart ring 10 further includes a plurality of first induction magnets 310 arranged on a side of the second ring body 200 adjacent to the first ring body 100, and the first induction magnets 310 may be strip-shaped magnets. The plurality of first induction magnets 310 are spaced apart along the circumferential direction of the second ring body 200, and the first induction magnets 310 are located between the first magnets 160 and the second magnets 210. The first magnetic induction member 170 and the second magnetic induction member 180 are configured to be mutually inductive with the plurality of first induction magnets 310 and form periodic signals. It should be understood that if the second magnet 210 is not arc-shaped or ring-shaped, but is strip-shaped, the strip second magnet 210 may be used as the first induction magnet 310. If the second magnet 210 has an arc-shaped or ring-shaped structure, a plurality of strip-shaped first induction magnets 310 are required to be arranged on the second ring body 200, and the first magnetic induction member 170 and the second magnetic induction member 180 are continuously inductive with the strip-shaped first induction magnets 310 to generate periodic signals.

It should also be noted that the first ring body 100 and the second ring body 200 may rotate counterclockwise and clockwise relative to each other. Different relative rotations between the first ring body 100 and the second ring body 200 may correspond to different control logic. Specifically, referring to FIG. 12 and FIG. 13, the second section 1212 of the flexible printed circuit board 121 further includes a first magnetic induction member 170 and a second magnetic induction member 180 that are electrically connected to the controller respectively. Based on pulse signals between the first magnetic induction member 170 and any one of the second magnets 210 and pulse signals between the second magnetic induction member 180 and any one of the second magnets 210, it can be determined whether the second ring body 200 rotates counterclockwise or clockwise relative to the first ring body 100, thereby outputting different control logic. The first magnetic induction member 170 and the second magnetic induction member 180 may be Hall devices, or magnetic induction devices such as magnetic switches and reed switches. When the first induction magnet 310 approaches to the first induction member 170, the first induction member 170 can be triggered to generate a conduction signal. When the first induction magnet 310 is away from the first induction member 170, the first induction member 170 can be triggered to generate a disconnection signal. In some embodiments, referring to FIG. 13, the first magnetic induction member 170 and the second magnetic induction member 180 are located between adjacent two first magnets 160, and the first magnetic induction member 170 and the second magnetic induction member 180 are further located between two adjacent two second magnets 210. The first magnetic induction member 170, the second magnetic induction member 180, and a center of the first ring body 100 form a first central angle A. The adjacent two first magnets 160 and the center of the first ring body 100 form a second central angle B. The second central angle B is an integer multiple of the first central angle A, such as 3 times, 4 times, etc.

According to the aforementioned smart ring 10, the smart ring 10 can be worn on a finger of the user, which is small in size and can be worn easily without causing any feeling of strangeness. Magnetic resistance generated by the mutual rotation between the first ring body 100 and the second ring body 200 provides playability and stress relief effects. At the same time, through the first magnetic induction member 170 and the second magnetic induction member 180, a rotation action can be accurately detected and a corresponding interactive instruction can be generated, and through the trigger assembly 140, the pressing action can be accurately detected and another corresponding interactive instruction can be generated. The smart ring 10 is compatible with two different dimensions of interactive operations and external device interactions, which effectively improves operability and accuracy of interaction. In addition, playability, decoration, and intelligent interaction are effectively integrated, which greatly improves application scenarios of the product.

The above-mentioned embodiments do not constitute a limitation on the protection scope of the technical solution. Any modifications, equivalent replacements and improvements made within the spirit and principles of the above-mentioned embodiments shall be included within the protection scope of this technical solution.

The foregoing descriptions are merely specific embodiments of the present disclosure, but are not intended to limit the protection scope of the present disclosure. Any variation or replacement readily figured out by a person skilled in the art within the technical scope disclosed in the present disclosure shall all fall within the protection scope of the present disclosure.

What is claimed is:

1. A smart ring, comprising:

a first ring body provided with a receiving hole, the receiving hole being configured to accommodate a finger of a wearer;

a second ring body movably sleeve on a periphery of the first ring body, and a first gap being formed between the first ring body and the second ring body in a circumferential direction of the smart ring;

a trigger assembly arranged on the first ring body and at least partially exposed from the first ring body; and a processing circuit arranged on the first ring body and electrically connected to the trigger assembly;

wherein the first ring body and the second ring body are capable of rotating with each other along the first gap, the second ring body is further movable relative to the first ring body in a radial direction of the smart ring, so as to receive a pressing operation and move toward the first ring body and enable an inner side of the second ring body to abut against a portion of the trigger assembly exposed from the first ring body, the trigger assembly is configured to generate a trigger signal when abutting against the second ring body, and the processing circuit is configured to convert the trigger signal into an interactive signal;

wherein the smart ring further comprises a first magnet provided on the first ring body and a second magnet provided on the second ring body, the first ring body is rotatable relative to the second ring body, and the first ring body and the second ring body are spaced apart in the radial direction under mutual magnetic force between the first magnet and the second magnet.

2. The smart ring of claim 1, wherein the first ring body is provided with a protruding portion, along the width direction of the first ring body, an edge of the second ring body is blocked by the protruding portion.

3. The smart ring of claim 1, wherein the trigger assembly is spaced apart from the first magnet and the second magnet.

4. The smart ring of claim 1, wherein a magnetic pole of a side of the first magnet facing the second ring body is the same as a magnetic pole of a side of the second magnet facing the first ring body.

5. The smart ring of claim 1, wherein a magnetic pole of a side of the first magnet facing the second ring body is different from a magnetic pole of a side of the second magnet facing the first ring body.

6. The smart ring of claim 1, wherein a plurality of first magnets and a plurality of second magnets are provided, the plurality of first magnets are spaced apart along the circumferential direction of the first ring body, a first spacing is formed between adjacent two first magnets, the plurality of second magnets are spaced apart along the circumferential direction of the second ring body, a second spacing is formed between adjacent two second magnets, the first magnet extends axially along the first ring body, the second magnet extends axially along the second ring body, a plurality of trigger assemblies are provided, and each trigger assembly is located between adjacent two first magnets.

7. The smart ring of claim 6, wherein the first ring body is circumferentially provided with a plurality of first accommodating grooves, each first accommodating groove extends axially along the first ring body, the first magnet is detachably inserted into the first accommodating groove, the second ring body is provided with a plurality of second accommodating grooves, each second accommodating groove extends axially along the second ring body, and the second magnet is detachably inserted into the second accommodating groove.

8. The smart ring of claim 7, wherein the first accommodating grooves have different sizes, and the second accommodating grooves have different sizes.

9. The smart ring of claim 8, wherein the trigger assembly comprises a trigger switch and a pressing member, the trigger switch is arranged on a side of the flexible printed circuit board adjacent to the second ring body, and the first ring body is provided with a through hole, the pressing member is arranged in the first ring body and is at least partially exposed from the through hole, and the pressing member is configured to be pressed to abut against the trigger switch, so that the trigger switch generates the trigger signal.

10. The smart ring of claim 9, wherein a plurality of through holes are provided, a plurality of pressing members are provided, a plurality of trigger switches are provided, the plurality of trigger switches are spaced apart along a circumferential direction of the flexible printed circuit board, the through holes, the pressing members, and the trigger switches are radially aligned in a one-to-one correspondence, the trigger switches have same functions or different functions, and a side surface of the second ring body is provided with identification marks corresponding to the functions of the trigger switches.

11. The smart ring of claim 9, wherein the pressing member comprises a plurality of supporting section, a plurality of connecting section, and a plurality of pressing section, each pressing section is connected to one supporting section, each supporting section is configured to abut against one trigger switch, each connecting section is connected between adjacent two supporting sections, the connecting sections and the supporting sections are located on a side of the pressing sections away from the through hole, and an area of each supporting section is larger than an area of the corresponding pressing section.

12. The smart ring of claim 11, wherein each pressing section is located on a middle of the first ring body in a width direction thereof.

13. The smart ring of claim 9, wherein the first ring body comprises a first housing and a second housing cooperatively enclosing to form a first mounting cavity, the through hole is provided on the first housing, the processing circuit is arranged in the first mounting cavity, the trigger assembly is partially located in the first mounting cavity, the second housing is provided with the receiving hole configured to sleeve on the finger of the wearer, the second housing is sealingly connected to the first housing, and a portion of the pressing member located in the through hole is made of a flexible material.

14. The smart ring of claim 1, further comprising a mounting bracket, a flexible printed circuit board, and a battery, wherein the flexible printed circuit board is bent and surrounds the mounting bracket, the battery is electrically connected to the flexible printed circuit board, the processing circuit is arranged on the flexible printed circuit board, and the battery is located in a space formed by bending of the flexible printed circuit board.

15. The smart ring of claim 14, wherein the processing circuit comprises a controller, a communication module, and a charging module, the controller is electrically connected to the communication module and the charging module respectively, the communication module is configured to communicate with an external device, the charging module is electrically connected to the battery and is configured to electrically connect an external charging device and charge the battery through the external charging device, the controller being is configured to receive the trigger signal and convert the trigger signal into an interactive signal, the interactive signal is sent by the communication module to the external device for interactive control, the controller, the communication module, and the charging module are arranged on a side of the flexible printed circuit board away from the second ring body, and the controller, the communication module, and the charging module are spaced apart along a circumferential direction of the flexible printed circuit board.

16. The smart ring of claim 15, further comprising a vital signs sensor arranged on the flexible printed circuit board and located between the communication module and the charging module, wherein the first ring body is provided with a transparent window corresponding to the vital signs sensor, and the vital signs sensor is configured to emit and receive light through the transparent window to detect vital signs of the wearer.

17. The smart ring of claim 15, wherein the charging module comprises a wireless charging coil electrically connected to the battery and the controller, the charging coil is configured to be electrically inductive with the external charging device to serve as a charging receiving end, and a side of the flexible printed circuit board away from the charging coil is provided with a magnetic shielding layer.

18. The smart ring of claim 14, wherein the flexible printed circuit board further comprises a first magnetic induction member and a second magnetic induction member that are electrically connected to a controller respectively, the smart ring further comprises a plurality of first induction magnet, the first induction magnets are a plurality of strip magnets, the plurality of first induction magnets are spaced apart along a circumferential direction of the second ring body, the first induction magnets are located between the first magnets and the second magnets, and the first magnetic induction member and the second magnetic induction member are configured to be mutually inductive with the plurality of first induction magnets and form periodic signals.

19. The smart ring of claim 1, wherein at least one of the first magnet and the second magnet has a ring structure defined by a plurality of arc structures, a central angle of each of the arc structures is greater than or equal to 72°.

20. The smart ring of claim 1, wherein two groups of first magnets are spaced apart along a width direction of the first ring body, two groups of second magnets are spaced apart along a width direction of the second ring body, and at least one of the first magnet and the second magnet has a ring structure.

* * * * *